US010267495B1

(12) United States Patent
Boiragi et al.

(10) Patent No.: US 10,267,495 B1
(45) Date of Patent: Apr. 23, 2019

(54) VISOR FOR A LIGHTING FIXTURE

(71) Applicant: Appleton Grp LLC, Rosemont, IL (US)

(72) Inventors: Indrajit Boiragi, Pune (IN); Jinchandra S. Palase, Pune (IN); Rajesh Hatewar, Pune (IN); Sudhir V. Managuli, Pune (IN); Harish P. Kulkarni, Pune (IN)

(73) Assignee: Appleton Grp LLC, Rosemont, IL (US)

( * ) Notice: Subject to any disclaimer, the term of this patent is extended or adjusted under 35 U.S.C. 154(b) by 0 days.

(21) Appl. No.: 15/907,571

(22) Filed: Feb. 28, 2018

(30) Foreign Application Priority Data

Dec. 19, 2017 (IN) ..... 201721045688

(51) Int. Cl.

| | |
|---|---|
| ***F21V 7/00*** | (2006.01) |
| ***F21V 17/16*** | (2006.01) |
| ***F21V 11/00*** | (2015.01) |
| ***F21V 17/02*** | (2006.01) |
| *F21Y 115/10* | (2016.01) |

(52) U.S. Cl.
CPC ..... *F21V 17/16* (2013.01); *F21V 7/00* (2013.01); *F21V 11/00* (2013.01); *F21V 17/02* (2013.01); *F21Y 2115/10* (2016.08)

(58) Field of Classification Search
CPC ..... F21V 17/196; F21V 17/00; F21V 11/00; F21V 17/02; F21V 17/16
See application file for complete search history.

(56) References Cited

U.S. PATENT DOCUMENTS

| | | | | |
|---|---|---|---|---|
| 1,589,760 | A * | 6/1926 | Kuen | F21S 41/29 362/374 |
| 3,033,982 | A | 5/1962 | Burns et al. | |
| 4,796,169 | A * | 1/1989 | Shemitz | F21V 11/18 362/282 |
| 4,814,957 | A * | 3/1989 | Dennis | F21L 14/02 362/110 |
| 2005/0117333 | A1* | 6/2005 | Yoshida | F21S 8/033 362/147 |
| 2011/0068708 | A1* | 3/2011 | Coplin | F21K 9/00 315/294 |

(Continued)

FOREIGN PATENT DOCUMENTS

| | | |
|---|---|---|
| JP | 2000011734 A | 1/2000 |
| JP | 2013065411 A | 4/2013 |

OTHER PUBLICATIONS

The International Search Report (ISR) with Written Opinion for PCT/IB2018/060173 dated Feb. 19, 2019, pp. 1-9.

*Primary Examiner* — Anabel Ton
(74) *Attorney, Agent, or Firm* — McDonnell Boehnen Hulbert & Berghoff LLP

(57) ABSTRACT

A visor for a lighting fixture is snap fitted to the lighting fixture that effectively reduces sky glow. The visor (100) comprises a central panel (104) and a pair of side panels (106). The pair of side panels (106) is extended from the operative ends of central panel (104). Further at least one connecting portion (108) having a hemmed formation (110) are configured on the central panel (104) and pair of side panels (106), wherein at least one clip (112) is fitted into the hemmed formation (110) that facilitates mounting of the visor (100) on the lighting fixture (102).

6 Claims, 3 Drawing Sheets

(56) References Cited

U.S. PATENT DOCUMENTS

2012/0250321 A1* 10/2012 Blincoe ..... F21V 7/00
362/247
2014/0301076 A1* 10/2014 Ter-Hovhannisyan .....
F21V 17/16
362/235

* cited by examiner

VISOR FOR A LIGHTING FIXTURE

RELATED APPLICATIONS

This application claims priority to Indian Application No. 201721045688 entitled "A Visor For a Lighting Fixture" filed on Dec. 19, 2017, the contents of which are incorporated by reference herein in their entirety.

FIELD

The present disclosure relates to the field of lighting fixtures. More particularly, the invention relates to a visor to be used with a lighting fixture.

BACKGROUND

Generally, lighting fixtures are used to hold the electrical light sources such as light emitting diodes (LEDs), wherein the fixture comprises a body and a socket to hold the bulbs or LEDs. The lighting fixtures may also consist of a visor to prevent light trespass towards the sky by blocking the upward directional light emitted by the light source. Moreover, to fasten the visor to the lighting fixture, a plurality of fasteners is required which further requires apertures to be machined on the visor and the lighting fixture to accommodate the fasteners. Furthermore, the use of fasteners such as a nut and bolt assembly increases the installation cost and time of the visor on the lighting fixture.

Therefore, there is felt a need for a visor for a lighting fixture that alleviates the abovementioned drawbacks of the conventional visors.

OBJECTS

Some of the objects of the present disclosure, which at least one embodiment herein satisfies, are as follows:

An object of the present disclosure is to provide a visor for a lighting fixture that effectively prevents sky glow, by blocking the upward directional light of the LEDs.

Another object of the present disclosure is to provide a visor for a lighting fixture that is snap fitted to the lighting fixture without the use of any kind of tools.

Yet another object of the present disclosure is to provide a visor for a lighting fixture that does not require fasteners for fixing to the lighting fixtures.

Other objects and advantages of the present disclosure will be more apparent from the following description, which is not intended to limit the scope of the present disclosure.

SUMMARY

The present disclosure envisages a visor for use with a lighting fixture. The visor comprises a central panel and a pair of side panels. The pair of side panels extends from the operative ends of the central panel. Further, at least one connecting portion extends from each of the central panel and the pair of side panels, wherein the connecting portions are configured to facilitate the mounting of the visor on the lighting fixture. The connecting portions having a hemmed formation are configured at a free operative end thereof.

The visor further comprises at least one clip configured to be fitted into the hemmed formation, thereby facilitating the fastening of the visor on the lighting fixture. The central panel of the visor is inclined at a pre-determined angle with respect to a front cover of the lighting fixture.

In an embodiment, the connecting portions are configured at edges of the central panel and the pair of side panels, wherein the central panel and the pair of side panels interface with the front cover.

In an embodiment, the visor is snap fitted onto the lighting fixture by means of at least one clip. Further, at least one of the central panel and the pair of side panels is provided with a reflecting surface.

In an embodiment, the at least one clip is pivotable within the hemmed formations.

In another embodiment, the pre-determined angle of the central panel with respect to the front cover of the lighting fixture is 70°.

BRIEF DESCRIPTION OF THE ACCOMPANYING DRAWING

A visor for use with a lighting fixture, of the present disclosure, will now be described with the help of the accompanying drawing, in which.

LIST OF REFERENCE NUMERALS USED IN THE DETAILED DESCRIPTION AND DRAWING

100—Visor
102—Lighting fixture
104—Central panel
106—Pair of side panels
108—Connecting portions
110—Hemmed formation
112—At least one clip
113—Connecting legs
114—Front cover
116—Guard
118—Optimized angle
120—Optimized length
122—Conventional length
124—Notches

DETAILED DESCRIPTION

Conventionally, lighting-fixtures are used to produce a desired degree of illumination. Typically, a lighting fixture comprises a visor to block the upward directional light emitted by a plurality of light sources such as LEDs, bulbs etc., fixed to the lighting fixture. However, to fasten the visor to the lighting fixture, a plurality of fasteners is required, which increases the number of apertures to be machined on the visor and on the lighting fixture to accommodate the fasteners. Furthermore, the field installation time of the visor on the lighting fixture increases.

Therefore, there is felt a need for a visor that alleviates the abovementioned drawbacks of conventional visors and prevents the sky glow. The present disclosure envisages a visor for use with a lighting fixture. The visor, of the present disclosure, is hereinafter described with reference to FIG. 1 through FIG. 5.

Figure 1:
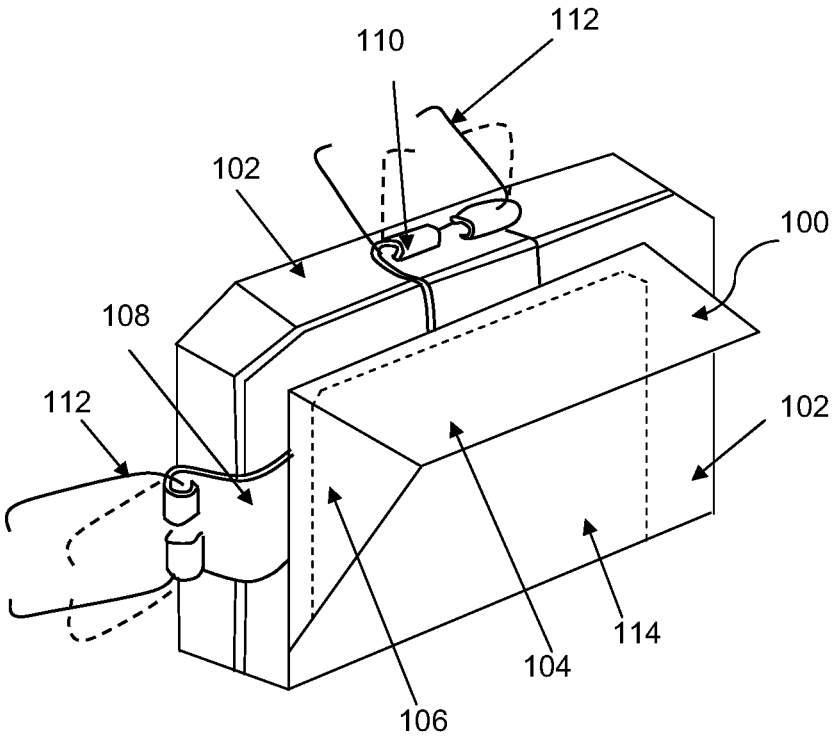
FIG. 1 illustrates an isometric view of a lighting fixture depicting a visor, in accordance with an embodiment of the present disclosure.
Figure 2:
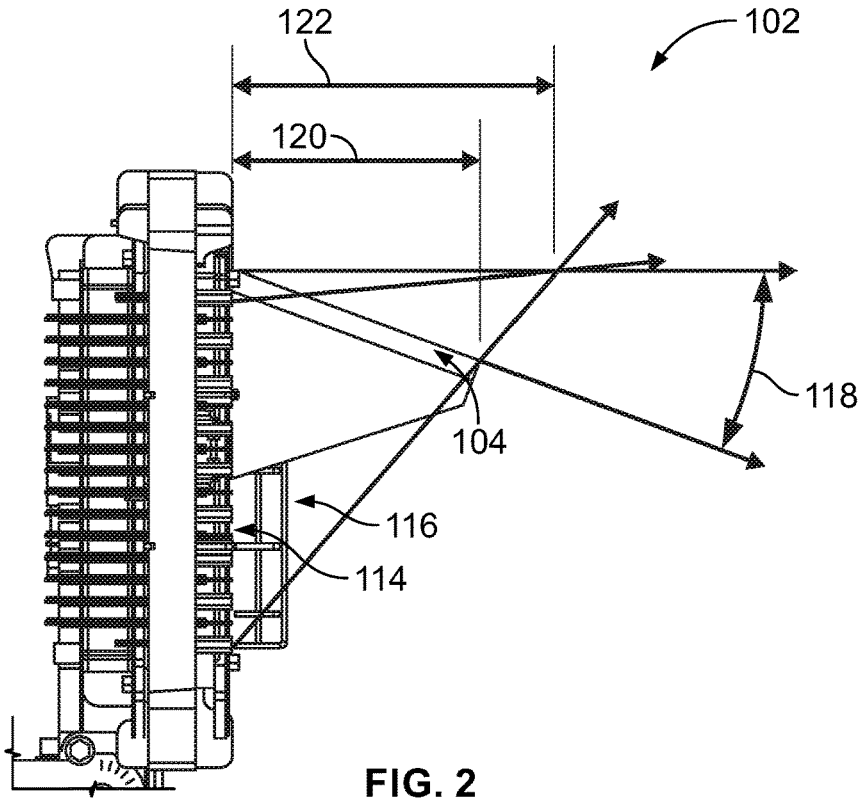
FIG. 2 illustrates a side view of a visor affixed to the lighting fixture, in accordance with an embodiment of the present disclosure.
Figure 3:
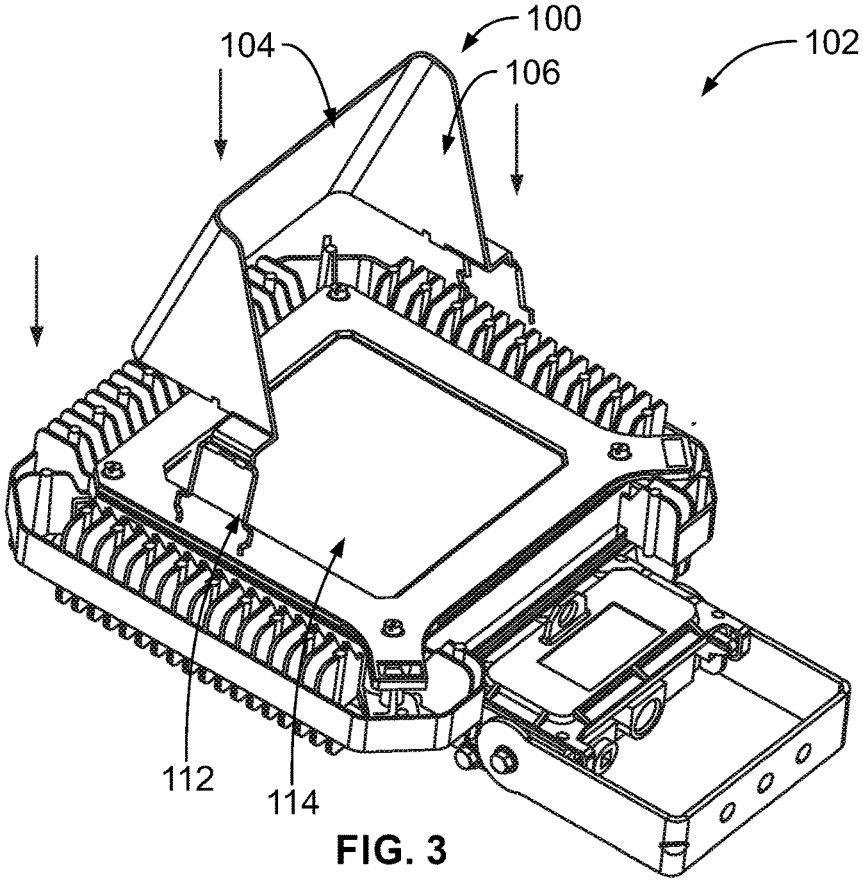
FIG. 3 illustrates an isometric view of a visor that is fastened to the lighting fixture, in accordance with an embodiment of the present disclosure.
Figure 4:
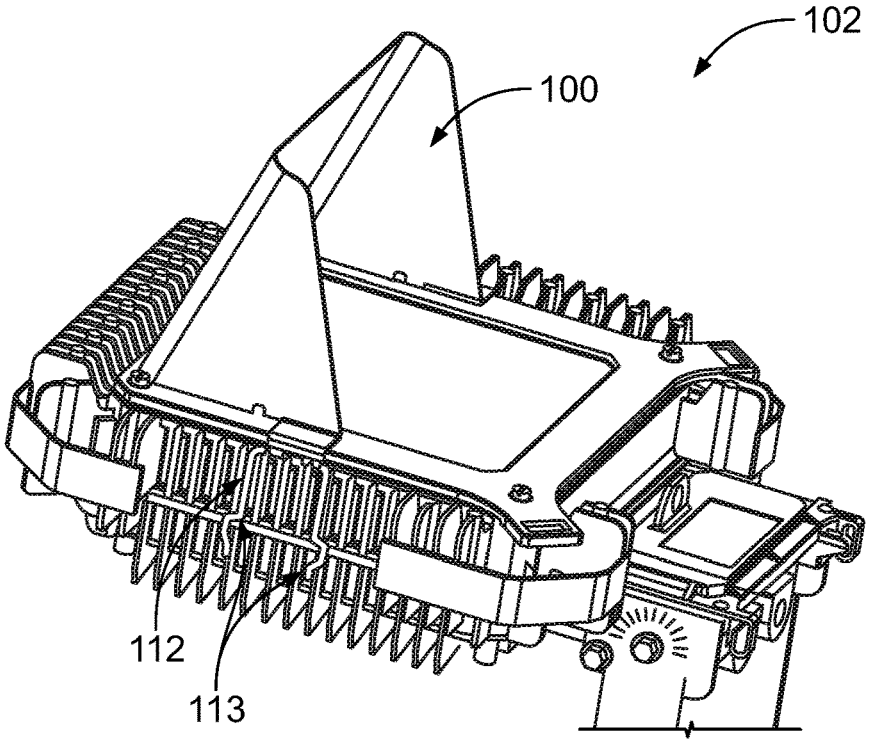
FIG. 4 illustrates an isometric view of the visor depicting a connecting portion of a clip fitted to the lighting fixture, in accordance with an embodiment of the present disclosure.
Figure 5:
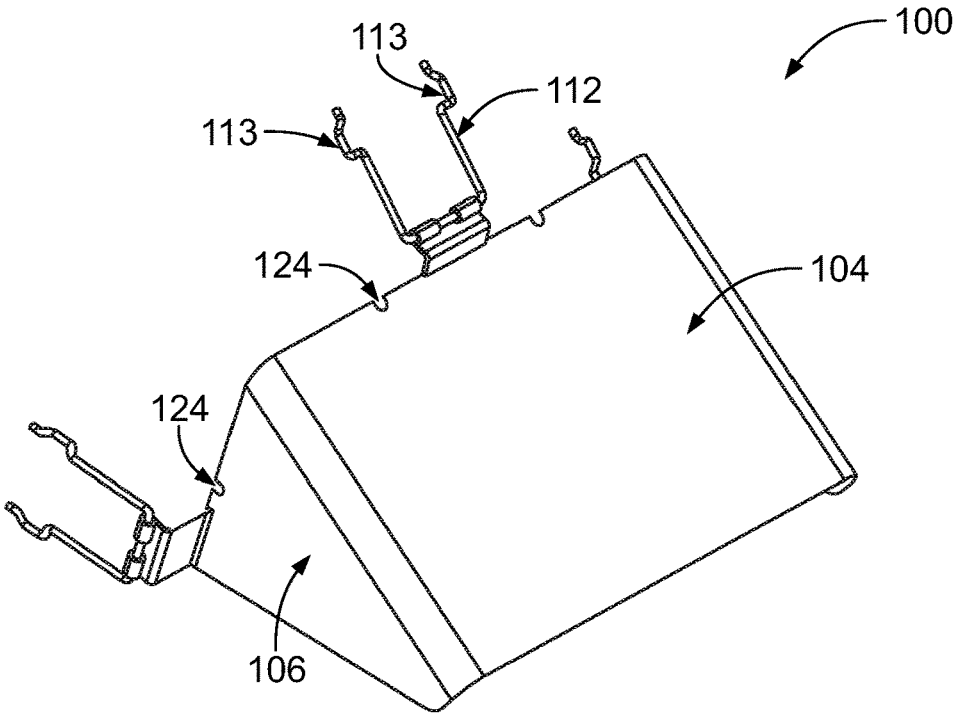
FIG. 5 illustrates an isometric view of the visor, in accordance with an embodiment of the present disclosure.

Referring to FIG. 1 and FIG. 5, a visor 100 for use with a lighting fixture 102 comprises a central panel 104, and a pair of side panels 106, wherein the pair of side panels 106 is extended from the operative ends of the central panel 104. Further, at least one connecting portion 108 is extended from each of the central panel 104 and the pair of side panels 106. The connecting portion 108 is configured to facilitate the mounting of the visor 100 on the lighting fixture 102. In an embodiment, the connecting portions 108 are configured centrally on the operative edges of the central panel 104 and pair of side panels 106, thereby forming a three-point contact, and allowing the visor 100 to be rigidly fixed to the lighting fixture 102.

Further, the free operative ends of the connecting portion 108 are hemmed to form a hemmed formation 110, wherein the hemmed formation 110 is configured to provide a link to fit at least one clip 112. The clip 112 is fitted into the hemmed formation 110 to facilitate fastening of the visor 100 on the lighting fixture 102. The hemmed formation 110 strengthens the connecting portions 108 so that the connection portion 108 can support the weight of the visor 100 connected to the lighting fixture 102.

In an embodiment, the clip 112 has a U-shaped profile having connecting legs 113 to securely fix to the lighting fixture 102. Further, the clip 112 has bent portions configured near the free ends of the connecting legs 113 adapted to operatively engage a plurality of fins extending from a periphery of the lighting fixture. The connecting legs 113 are extended and undergo a spring back action to rigidly hold the visor 100 of the lighting fixture 102 in operative engagement with the fins. In an embodiment, the visor 100 is snap fitted in engagement with the fins onto the lighting fixture 102 by means of the clip 112. The clip 112 has smooth extended ends at the connecting legs 113 which facilitate easy sliding of the at least one clip 112, and prevents any damage to the lighting fixture 102. In an embodiment, the clip 112 has any other profile which provides rigid fitment of the visor 100 with the lighting fixture 102.

Further, the clip 112 is pivotable within the hemmed formation 110 of the connecting portions 108. In an embodiment, the angle of rotation of the clip 112 is 320°, which provides pivotable motion to the at least one clip 112 within the hemmed formation 110. Further, the use of the clips 112 for fitting the visor 100 to the lighting fixture 102 eliminates the use of any fasteners, thereby eliminating the use of any tools required to fix the visor 100. Moreover, the installation time and maintenance required for the visor 100 is reduced as compared to the conventional visors. In another embodiment, the at least one clip 112 is replaceable.

Further, the central panel 104 is inclined at a pre-determined angle with respect to a front cover 114 of the lighting fixture 102. In an embodiment, the pre-determined angle is 70°. In an exemplary embodiment, the central panel of a conventional visor is inclined at an angle of 90°. The pre-determined angle of the central panel 104 of the visor 100 of the present disclosure is optimized by 20° compared to the conventional visor for the lighting fixture 102. An optimized angle 118 of 20° provides a tilt angle to the visor 100, which maximizes a forward coverage of the light emitted by a plurality of LEDs fixed to the lighting fixture 102. Further, optimizing of the angle of the central panel 104 of the visor 100 also reduces the conventional length 122 of the central panel 104, thereby providing minimal upward waste light illuminated by the LEDs. In an embodiment, the optimized length 120 and optimized angle 118 of the central panel 104 of the present disclosure reduces sky glow (minimal upward waste light) substantially when compared to the conventional visor.

In an embodiment, the central panel 104 and the pair of side panels 106 of the visor 100 are provided with a reflecting surface which enhances the effective utilization of light emitted by the LEDs.

In an embodiment, the connecting portions 108 configured at operative edges of the central panel 104 and the pair of side panels 106 interface with the front cover 114. In an exemplary embodiment, a plurality of notches 124 are provided at the operative edges of the central panel 104 and the pair of side panels 106 to facilitate the fitment of the visor 100 over a guard 116, wherein the guard 116 is disposed between the front cover 114 and the lighting fixture 102.

In an embodiment, the visor 100 comprising the central panel 104, the pair of side panels 106, the connecting portions 108, the hemmed formation 110, the at least one clip 112 and the connecting legs 113 is made of steel. In another embodiment, the visor 100 and the clips 112 of made of any metal or any suitable non-metallic material.

The visor 100, of the present disclosure, provides tool less operation to fit the visor 100 to the lighting fixture 102. Further, the visor 100 also reduces sky glow and enhances the effective utilization of light emitted by the LEDs and the like.

TECHNICAL ADVANCEMENTS

The present disclosure described herein above has several technical advantages including, but not limited to, the realization of a visor for a lighting fixture that:

- effectively prevents sky glow, by blocking the upwards directional light of a plurality of LEDs;
- requires no tools and fasteners for fixing to the lighting fixtures; and
- is snap fitted to a lighting fixture.

The foregoing disclosure has been described with reference to the accompanying embodiments which do not limit the scope and ambit of the disclosure. The description provided is purely by way of example and illustration.

The embodiments herein and the various features and advantageous details thereof are explained with reference to the non-limiting embodiments in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The foregoing description of the specific embodiments so fully revealed the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

The use of the expression "at least" or "at least one" suggests the use of one or more elements or ingredients or quantities, as the use may be in the embodiment of the disclosure to achieve one or more of the desired objects or results.

Any discussion of documents, acts, materials, devices, articles or the like that has been included in this specification is solely for the purpose of providing a context for the disclosure. It is not to be taken as an admission that any or all of these matters form a part of the prior art base or were common general knowledge in the field relevant to the disclosure as it existed anywhere before the priority date of this application.

The numerical values mentioned for the various physical parameters, dimensions or quantities are only approximations and it is envisaged that the values higher/lower than the numerical values assigned to the parameters, dimensions or quantities fall within the scope of the disclosure, unless there is a statement in the specification specific to the contrary.

While considerable emphasis has been placed herein on the components and component parts of the preferred embodiments, it will be appreciated that many embodiments can be made and that many changes can be made in the preferred embodiments without departing from the principles of the disclosure. These and other changes in the preferred embodiment as well as other embodiments of the disclosure will be apparent to those skilled in the art from the disclosure herein, whereby it is to be distinctly understood that the foregoing descriptive matter is to be interpreted merely as illustrative of the disclosure and not as a limitation.

We claim:

1. A combination of a visor (100) and a lighting fixture (102), comprising:

a visor (100) having:

a central panel (104); and a pair of side panels (106) extending from the operative ends of said central panel (104); and a lighting fixture (102) having a front cover (114) and a plurality of fins extending from a periphery of the lighting fixture;

the visor (100) further including at least one connecting portion (108) extending from each of said central panel (104) and said pair of side panels (106), said connecting portions (108) configured to facilitate mounting of said visor (100) on said lighting fixture (102), said connecting portions (108) having a hemmed formation (110) configured at a free operative end thereof;

at least one clip (112) configured to be fitted into said hemmed formation (110) and to operatively engage the plurality of fins on the lighting fixture to facilitate the fastening of said visor (100) on said lighting fixture (102);

wherein central panel (104) is inclined at a pre-determined angle with respect to the front cover (114) of said lighting fixture (102).

2. The combination as claimed in claim 1, wherein said connecting portions (108) are configured at edges of said central panel (104) and said pair of side panels (106), interfacing with said front cover (114).

3. The combination as claimed in claim 1, wherein visor (100) is snap fitted onto said plurality of fins of said lighting fixture (102) by means of said at least one clip (112).

4. The combination as claimed in claim 1, wherein at least one of said central panel (104) and said pair of side panels (106) is provided with a reflecting surface.

5. The combination as claimed in claim 1, wherein said at least one clip (112) is pivotable within said hemmed formations (110).

6. The combination as claimed in claim 1, wherein said pre-determined angle of said central panel (104) with respect to said front cover (114) of said lighting fixture (102) is 70°.

* * * * *